US007811135B2

(12) United States Patent
Idzik et al.

(10) Patent No.: US 7,811,135 B2
(45) Date of Patent: Oct. 12, 2010

(54) CONNECTOR FOR ELECTRONIC DEVICES

(75) Inventors: Jack S. Idzik, Kenilworth (CA); Ryan Mitchell Bayne, Waterloo (CA); Ben Boomhour, Waterloo (CA)

(73) Assignee: Research In Motion Limited, Waterloo, Ontario (CA)

( * ) Notice: Subject to any disclaimer, the term of this patent is extended or adjusted under 35 U.S.C. 154(b) by 0 days.

(21) Appl. No.: 12/424,028

(22) Filed: Apr. 15, 2009

(65) Prior Publication Data

US 2009/0215317 A1 Aug. 27, 2009

Related U.S. Application Data

(62) Division of application No. 11/739,893, filed on Apr. 25, 2007, now Pat. No. 7,537,458.

(51) Int. Cl.
*H01R 24/00* (2006.01)

(52) U.S. Cl. ..... 439/629; 439/67; 439/862

(58) Field of Classification Search ..... 439/65, 439/67, 74, 629, 862
See application file for complete search history.

(56) References Cited

U.S. PATENT DOCUMENTS 3,941,442 A * 3/1976 Friend ..... 439/862
4,563,725 A 1/1986 Kirby
4,592,617 A * 6/1986 Seidler ..... 439/876
4,647,126 A * 3/1987 Sobota, Jr. ..... 439/74
5,191,404 A * 3/1993 Wu et al. ..... 257/724
6,116,957 A 9/2000 Mickievicz et al.
6,688,892 B2 * 2/2004 Fukumoto et al. ..... 439/65
6,722,896 B2 4/2004 McGrath et al.
6,765,805 B2 * 7/2004 Naruse et al. ..... 361/803

(Continued)

FOREIGN PATENT DOCUMENTS

CA 1061874 4/1979

(Continued)

OTHER PUBLICATIONS

Research in Motion Limited, BlackBerrySmart Card Reader, 2005.

(Continued)

*Primary Examiner*—James Harvey
(74) *Attorney, Agent, or Firm*—Bereskin & Parr LLP/S.E.N.C.R.L., s.r.l.

(57) ABSTRACT

Various embodiments are provided herein for a connector that can provide electrical and mechanical coupling between first and second objects. In one broad aspect, the connector generally comprises at least one connecting element that has at least one first and at least one second contact portions; at least one guidance portion located towards an end of a given connecting element and adjacent to the at least one first contact portion; a straight end portion comprising the at least one second contact portion, and connected to one of the first and second objects by a solder connection; and a biasing portion that is adjacent to the at least one first contact portion and the straight end portion. The biasing portion is configured to provide an electrical connection between the at least one first and the at least one second contact portions and to resiliently move the given connecting element from a first position to a second position to provide a mechanical coupling force to the first and second objects.

20 Claims, 5 Drawing Sheets

U.S. PATENT DOCUMENTS

| | | | | |
|---|---|---|---|---|
| 6,896,561 | B2 | 5/2005 | Lai | |
| 6,926,565 | B2 * | 8/2005 | Fogg | 439/862 |
| 7,291,037 | B2 | 11/2007 | Tsai | |
| 7,338,332 | B2 * | 3/2008 | Simonsson et al. | 439/729 |
| 7,537,458 | B2 * | 5/2009 | Idzik et al. | 439/65 |
| 7,717,751 | B2 * | 5/2010 | Bellotto et al. | 439/629 |
| 2002/0186553 | A1 | 12/2002 | Inoue et al. | |
| 2005/0085140 | A1 | 4/2005 | Lai | |
| 2006/0042816 | A1 | 3/2006 | Sakurai et al. | |
| 2008/0268713 | A1 * | 10/2008 | Idzik et al. | 439/629 |
| 2009/0215317 | A1 * | 8/2009 | Idzik et al. | 439/629 |

FOREIGN PATENT DOCUMENTS

| | | |
|---|---|---|
| EP | 0506445 | 9/1992 |
| EP | 0969557 | 1/2000 |
| EP | 1638379 | 3/2006 |
| FR | 2340634 | 9/1977 |
| GB | 1563363 | 3/1980 |

OTHER PUBLICATIONS

Smart Card from wikipedia, retrieved from http://en.wikipedia.org/wiki/Smart_card, page last modified Nov. 12, 2006.

Search and Examination report for corresponding EP patent application No. 07106916.5 dated Oct. 15, 2007.

www.cyberd.co.uk/support/technotes/smartcards.htm, Technical Notes: ISO/IEC Chip Card Standards, downloaded from the internet on Aug. 25, 2008.

www.iso.org/iso/en/CatalogueDetailPage.CatalogueDetail?CSNUMBER=29257&ICS1=35&ICS2=240&ICS3=15, Technical Notes: ISO/IEC 7816-1:1998, Identification cards—Integrated circuit(s) cards with contacts—Part 1: Physical Characteristics, downloaded from the internet on Aug. 22, 2007.

www.iso.org/iso/en/CatalogueDetailPage.CatalogueDetail?CSNUMBER=2653&ICS1=35&ICS2=240&ICS3=15, Technical Notes: ISO/IEC 7816-2:1999, :Identification cards—Integrated circuit cards—Part 2: Cards with contacts—Dimensions and location of the contacts, downloaded from the internet on Aug. 22, 2007.

* cited by examiner

CONNECTOR FOR ELECTRONIC DEVICES

CROSS-REFERENCE TO RELATED APPLICATIONS

This application is a divisional of application Ser. No. 11/739,893, filed on Apr. 25, 2007, entitled CONNECTOR FOR ELECTRONIC DEVICES, the contents of which are herein incorporated by reference.

FIELD

The embodiments described herein generally relate to a connector that provides an electrical coupling between two objects having contact areas and can also provide physical or mechanical coupling to ensure that the elements that are electrically coupled are physically secure.

BACKGROUND

A smart card is an apparatus that can display visual information, such as a photograph or an identification bar code, on its surface and also store electronic information on an embedded microchip. Information is transferred to and from the smart card's microchip when it is inserted into a card reader, or a similar interface device. The type of information contained on the microchip often includes security clearances, group or project access permissions, encryption keys, and other sensitive, user-specific information.

A smart card can be used in applications which require a double authentication process since an individual's identity, specific security clearance, and project authorizations can be gathered via visual inspection of the card's surface, and can then be verified electronically by inserting the smart card into a card reader. Security clearances and data encryption keys stored on smart cards can also be verified using mobile card readers for use with mobile devices.

However, current smart card designs have the visual identification information on the same side of the card as electrical contacts that are used for accessing the electronic information from the microchip. Furthermore, most current card readers use a design with bulky components, which makes it difficult to display the visual information on the card and create an electrical contact with the card reader at the same time. In particular, this problem is caused by current electrical connection designs that require structural strength and a mechanical clamping force to be applied by the card reader's housing. The result of this housing requirement is a relatively thick and bulky card reading device with a housing that typically covers at least some of the card's visual information.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

DETAILED DESCRIPTION OF THE EMBODIMENTS

Figure 2A:
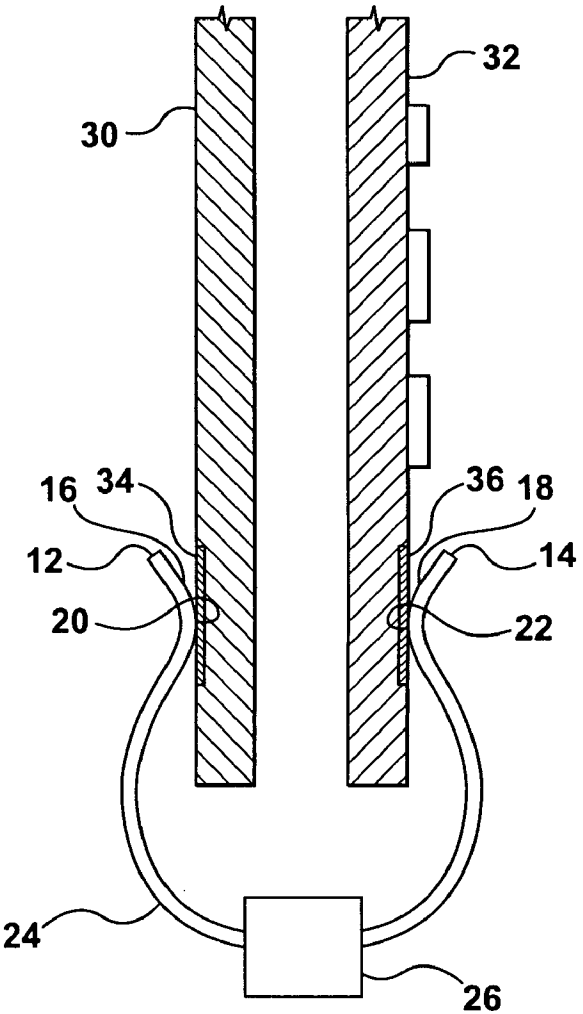
FIG. 2A is a cross-sectional side view of the connector of FIGS. 1A and 1B providing electrical and physical coupling between two objects.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Figure 1B:
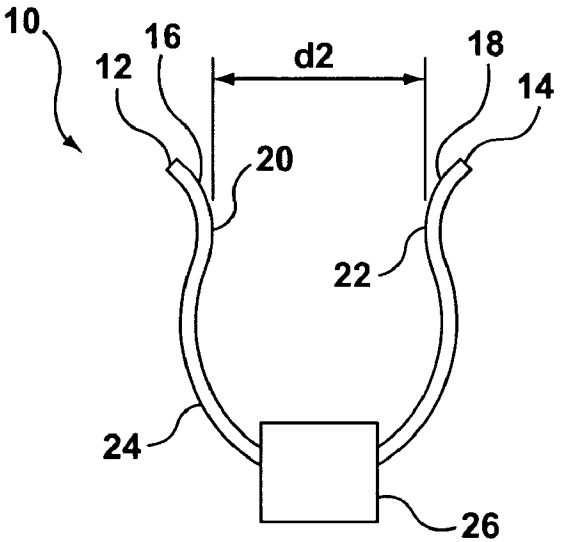
FIG. 1B is a front view of the connector of FIG. 1A in a second position.
Figure 1A:
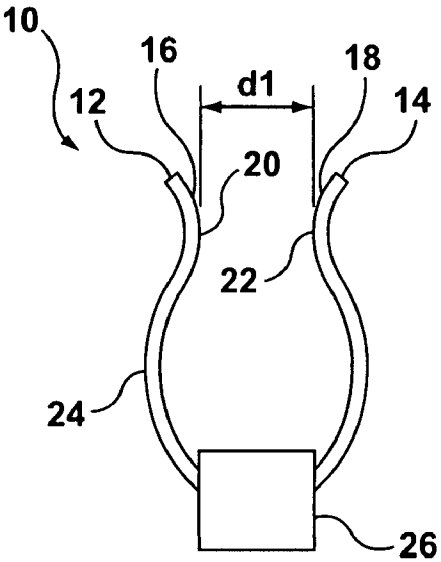
FIG. 1A is a front view of an exemplary embodiment of a connector in a first position.

Referring now to FIGS. 1A and 1B, shown therein are front views of an exemplary embodiment of a connector 10 in first and second positions respectively. The connector 10 includes two free ends 12 and 14, first and second guidance portions 16 and 18, first and second contact portions 20 and 22, a biasing portion 24 and an insulating member 26. The connector 10 can have a horseshoe shape as shown in FIG. 1, but in other embodiments, may have a different shape as long as the functionality of the guidance portions 16 and 18, electrical contact portions 20 and 22 and the biasing portion 24 is retained.

The first and second contact portions 20 and 22 and the biasing portion 24 are conductive so that there is an electrical connection between the first and second contact portions 20 and 22. Accordingly, the connector 10 can electrically couple contact areas on two objects when the connector 10 is applied to those objects such that the first and second contact portions 20 and 22 make electrical contact with the contact areas on the two objects. The first and second contact portions 20 and 22 are generally on first and second opposing sides or arms of the connector 10.

The connector 10 can be made from a piece of conductive wire that has sufficient mechanical properties and that is insulated as required. The connector 10 can have a round cross-section. However, it should be understood by those skilled in the art that the conductor can have any suitable cross-sectional geometry, such as having a square or rectangular cross-section, while maintaining its required functionality. In addition, the connector 10 may have different cross-sectional geometries throughout its length. In at least some cases, the connector 10 can be made from a single piece of conductive wire.

The connector 10 is semi-rigid (i.e. resilient) and can therefore also provide mechanical coupling between the two objects when the distance between the contact areas on the two objects is larger than dl (i.e. the distance between the first and second contact portions 20 and 22). In the first position (FIG. 1), the connector 10 is in a relaxed state. However, in the second position (FIG. 2), the first and second contact portions 20 and 22 move away from one another, because the connector 10 has been applied to the two objects, so that the connector 10 is now in a tensioned state. In the second position, the distance between the two contact portions 20 and 22 is d2, which is larger than dl. In the second position, the connector 10 attempts to return to its steady state, relaxed configuration (i.e. the first position) as a result of the natural elastic properties of the material chosen to make the connector 10. This creates a mechanical compressive spring force in the connector 10 that can be used to mechanically clamp or couple the two objects together while at the same time the desired electrical connection is created and maintained between the two objects.

Accordingly, the connector 10 is made with a material that is at least partially flexible, such that the connector 10 can apply the required mechanical compressive force without breaking. The connector 10 can be made using, but not limited to, spring-pin material for example. The connector 10 may also be plated with gold or another suitable metal to provide a hard surface that does not wear, provides a good electrical contact and does not corrode. Different strength materials can be selected to handle different mechanical loads as required.

To aid in the movement between the first and second positions, the first and second guidance portions 16 and 18 are shaped such that the free ends 12 and 14 of the connector 10 are splayed outward by a certain distance. This allows the two sections or arms of the connector 10 to move away from one another when the connector 10 is applied to two objects. Accordingly, the first and second guidance portions 16 and 19 allow for easy application of the connector 10 to two objects.

The insulating member 26 is shown with an exemplary rectangular shape. In other embodiments, the insulating member 26 can be shaped differently as required such that the biasing portion 24 does not make any unintended electrical contact. The insulating member 26 can also be placed in a different location along the connector 10. In some cases the insulating member 26 can be optional. For instance, in an alternative embodiment, the majority of the connector, except for the first and second contact portions, may be covered with an insulating material. In other instances, the connector may be used in such a way that there is no possibility of portions of the connector 10 making an electrical contact other than with the first and second contact portions 20 and 22. Alternatively, in some embodiments, the insulating member 26 can be provided by other elements, such as the housing of a device that employs the connector 10.

Referring now to FIG. 2A, shown therein is a cross-sectional side view of the connector 10 providing electrical and physical coupling between two objects 30 and 32 having contact areas 34 and 36 respectively. The objects 30 and 32 can be a printed circuit board, a data card or any other electronic components that have a contact area and require connection to another object. The first and second contact portions 20 and 22, along with the biasing portion 24 also exert a mechanical pressure while creating an electrical connection with the contact areas 34 and 36 to allow for the transfer of information between the two objects 30 and 32.

In this case, the two objects 30 and 32 are positioned relative to one another so that the contact areas 34 and 36 are at similar locations relative to one another; accordingly the first and second contact portions 20 and 22 of the connector 10 can be located somewhat directly across from one another. In other cases, the contact areas 34 and 36 may be at different heights relative to one another. In these cases, alternative embodiments of the connector 10 can be used in which the positions of the first and second contact portions 20 and 22 on the connector 10 are altered in a similar fashion so that electrical connections can be made as needed. The insulating member 26 can be placed adjacent to the housing that encloses the two objects 30 and 32, or in some cases may be provided by the housing.

The first and second guidance portions 16 and 18 and the free ends 12 and 14 of the connector 10 are offset from the outer surfaces of the objects 30 and 32, and the connector 10 is in the second tensioned positioned. When the connector 10 is first applied to the objects 30 and 32, the upper surfaces of the guidance portions 16 and 18 contact the bottom surfaces of the objects 30 and 32 which forces the first and second contact portions 20 and 22 away from one another. The connector 10 is then slid upwards until the first and second contact portions 20 and 22 contact the contact areas 34 and 36. In alternative embodiments, the connector 10 can also include a stopping portion such as, but not limited to, a rib (not shown), that restricts the movement of the connector 10 to ensure that it remains in place. The connector 10 can also be held in place, electrically and physically contact one of the objects 30 and 32, while the other object is slid into place such that there is electrical and physical coupling between the first and second contact portions 20 and 22 and the contact areas 34 and 36. This can occur once during manufacturing, or may occur throughout the use of a device, which utilizes the objects 30 and 32 if one of the objects is sometimes removed. For example, the configuration of the first and second guidance portions 16 and 18 allows for easy insertion and removal of a data card within an electronic device.

Figure 2B:
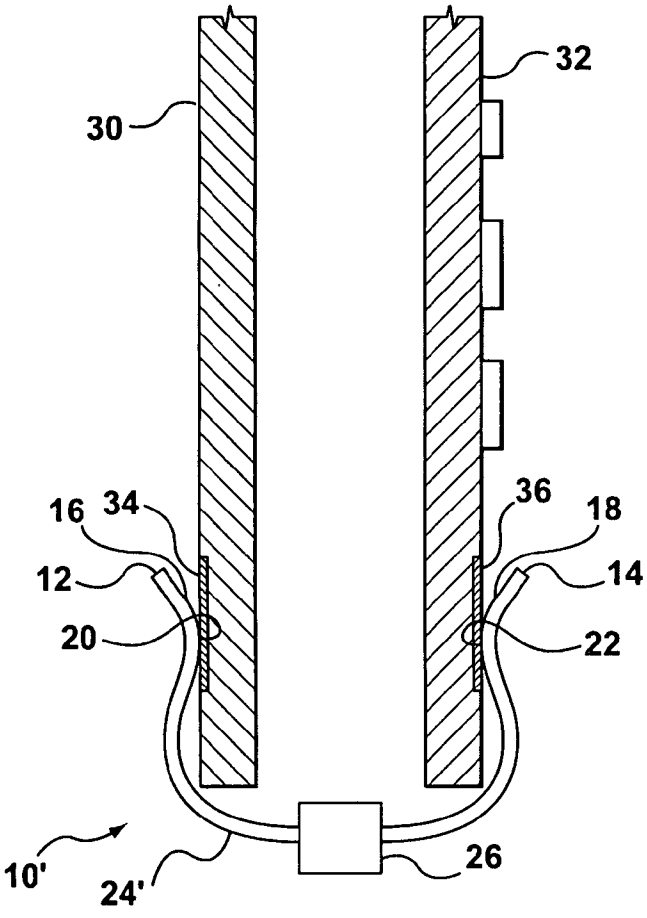
FIG. 2B is a cross-sectional side view of an exemplary embodiment of an alternative connector providing electrical and physical coupling between two objects.

Furthermore, in the exemplary embodiment of FIG. 2A, the connector 10 is arranged such that there is a clearance area between the bottom of the first and second objects 30 and 32 with respect to an upper surface of the biasing portion 24. Alternatively, referring to FIG. 2B, shown therein is an exemplary embodiment of an alternative connector 10' that can also provide electrical and physical coupling between the objects 30 and 32. In this case, the upper surface of the biasing portion 24 is arranged to abut with the bottom of at least one of the first and second objects 30 and 32. In this example, the biasing portion 24 abuts with the bottoms of both of the objects 30 and 32.

Figure 3B:
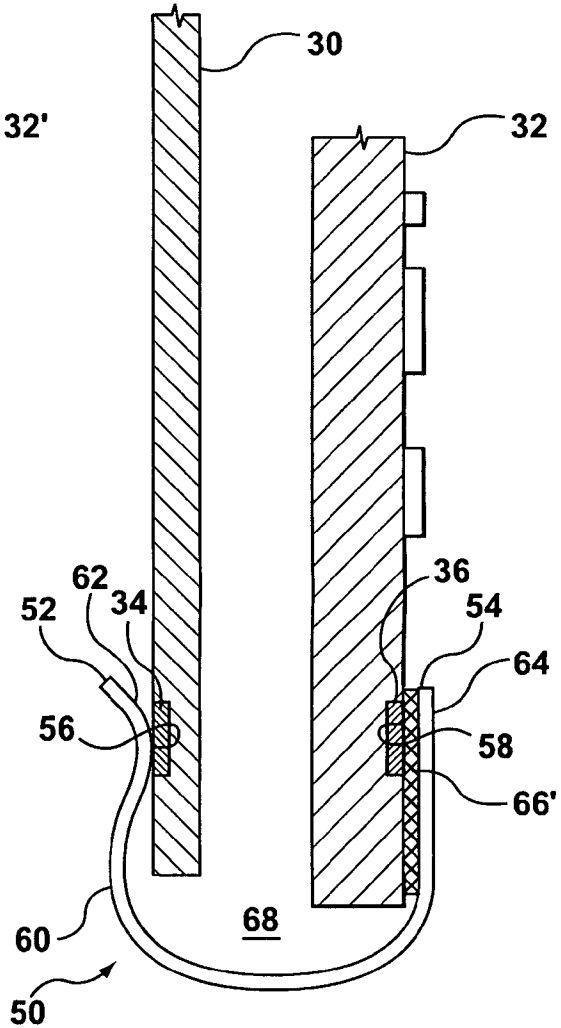
FIG. 3B is a cross-sectional side view of the connector of FIG. 3A providing electrical and altered physical coupling between two objects.
Figure 3A:
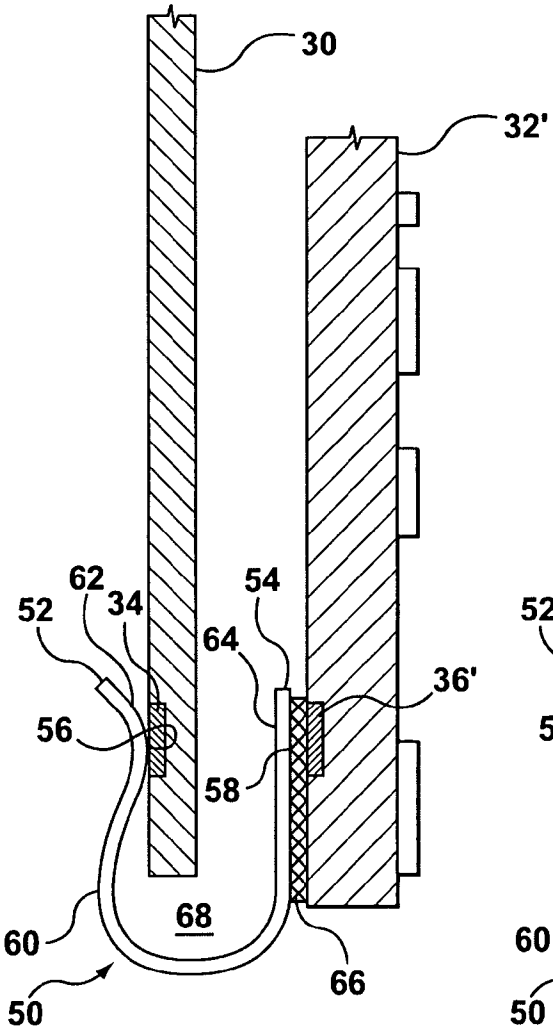
FIG. 3A is a cross-sectional side view of an exemplary embodiment of another alternative connector providing electrical and physical coupling between two objects.

Referring now to FIG. 3A, shown therein is a cross-sectional side view of an exemplary embodiment of another alternative connector 50 that can provide electrical and physical coupling between two objects 30 and 32'. The connector 50 also includes two free ends 52 and 54, first and second contact portions 56 and 58, and a biasing portion 60. An insulating member is not shown but one may be used; alternatively an insulating layer may be used as required which does not cover any contact areas of the connector 50. The connector 50 also includes a first guidance portion 62 similar to that of connector 10. The other end portion 64 of the connector 50 is physically and electrically connected to the object 32' by a permanent solder connection 66.

Once the object 32' is assembled and the solder connection made with the connector 50, the object 30 can be slid into place. Once again, the connector 50 has a relaxed state, and when the object 30 is slid into place, the bottom of the object 30 touches the first guidance portion 62, pushing this portion 62 of the connector 50 outwards which moves the connector 50 into the second tensioned position. The object 30 is then positioned so that the contact area 34 is electrically and physically coupled to the first contact portion 56. Once again, this embodiment allows for easy insertion and removal of a data card with an electronic device.

The contact areas 34 and 36 of the first and second objects 30 and 32' can be facing in the same direction as shown in FIG. 3A. Alternatively, these contact areas can be facing in opposite directions as shown in FIG. 3B, and the opposite side of the straight-end portion 64 of the connector 50 can be soldered to the object 32 as shown. In addition, while FIGS. 3A and 3B show a clearance area 68 between the bottom of the objects 30, 32' and 32, respectively, it should be understood that there can be other embodiments in which the bottom of the objects 30, 32' and 32 can abut with an upper surface of the biasing portion of the connector 50. Also, it should be understood that the width of the connector 50 (i.e. the distance between the first and second contact portions 56 and 58 in the first position), as well as its tensile properties, can be adjusted as needed depending on how it is attached to the object 32, 32'.

Figures 4A, 4B, 4C, 4D:
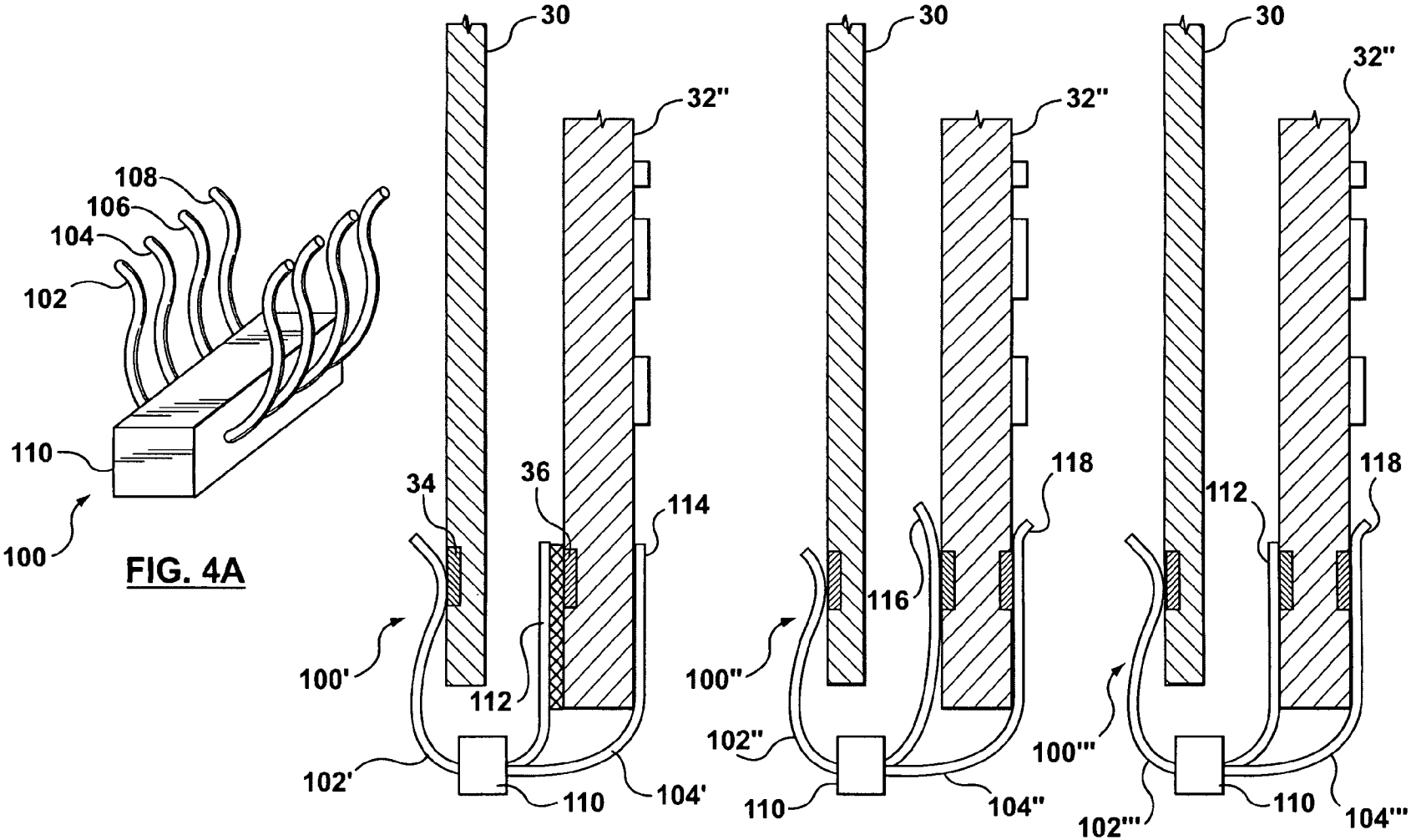
FIG. 4A is an isometric view of an exemplary embodiment of another alternative connector.
FIG. 4B is a cross-sectional side view of an exemplary embodiment of another alternative connector providing electrical and physical coupling between two objects.
FIG. 4C is a cross-sectional side view of an exemplary embodiment of another alternative connector providing electrical and altered physical coupling between two objects.
FIG. 4D is a cross-sectional side view of an exemplary embodiment of another alternative connector providing electrical and altered physical coupling between two objects.

Referring now to FIG. 4A, shown therein is an isometric view of an exemplary embodiment of another connector 100. The connector 100 comprises a plurality of connecting elements 102-108 and a carrier or insulating member 110. Previous embodiments showed connectors with one connecting element, but connector 100 includes a plurality of connecting elements 102-108. The connecting elements 102-108 are similar to connector 10. Accordingly, the connecting elements 102-108 have a first relaxed position when not in use, and a second tensioned position during use in which the connector 100 physically and electrically couples two objects.

The connecting elements 102-108 can be made from a conductive material having the required electrical and mechanical characteristics. The insulating member 110 can be comprised of any appropriate and available non-conductive material, such as plastic, that has the desired mechanical properties while reducing the potential for an electrical short circuit or interference between the connecting elements 102-108.

The connector 100 can be used to electrically connect contact areas on two objects in which the contact areas include multiple contact regions or contact pads. In this case, the number of connecting elements can be the same or greater than the number of contact regions. The insulating member 110 is produced such that the connecting elements 102-108 are maintained in a certain spaced relationship to match the layout of the contact regions on the two objects. In this regard, the heights of the contact portions of each of the connecting elements 102-108 can also be set to match the layout of the contact regions on the two objects. Accordingly, the height of at least one of the connecting elements 102-108 may be different when compared to the remaining connecting elements. Further, the heights of opposite ends of one of a given connecting elements may be different.

It should also be noted that there can be variations of the connector 100. For instance, the connecting elements 102-108 can be shaped such that these elements have a similar shape as the connecting elements shown in FIGS. 3A and 3B. In this case, one side of the connecting elements of the connector 100 can be soldered to an object. In another alternative, some, but not all, of the connecting elements 102-108 can have a shape similar to the connecting element shown in FIGS. 3A and 3B and be used to connect contact regions on a first object to contact regions on a second object in which the second object has some contact regions on an opposite side compared to the first object and some contact regions on the same side compared to the first object. For example, as shown in FIG. 4B, connector 100' includes two connecting elements 102' and 104' which have one side with straight end portions 112 and 114 respectively that can be soldered to opposite sides of the object 32". Alternatively, another connector 100" includes two connecting elements 102" and 104" with curved guidance portions 116 and 118 as shown in FIG. 4C and no soldering is required. In another alternative, another connector 100''' includes two connecting elements 102''' and 104''' which have a straight and curved end portion 112 and 118 respectively as shown in FIG. 4D and no soldering is required. This last configuration may also be reversed so that connecting element 102''' includes a curved end portion 116 and connecting element 104''' includes a straight end portion 114.

In each of FIGS. 4B-4D, the other end of the variations of connecting elements 102 and 104 has a guidance portion. Also, in FIGS. 4C and 4D, the right hand side of the connecting elements 102" and 104", and 102''' and 104''', respectively, can be arranged to have a first relaxed position, when not applied to the object 32", and a second tensioned position when applied to the object 32". The connectors 100" and 100''' of FIGS. 4C and 4D can also be modified to handle the situation in which the electrical areas on the two objects directly face one another; in these cases, the relative layout of the connecting elements, in which on one side of the connector the connecting elements have end portions on either side of the object, can be duplicated on both sides of the connector. In addition, an extra connecting element can be included to provide this "sandwich" mechanical coupling on a given one of the data objects and not be used for electrical coupling.

Figure 5C:
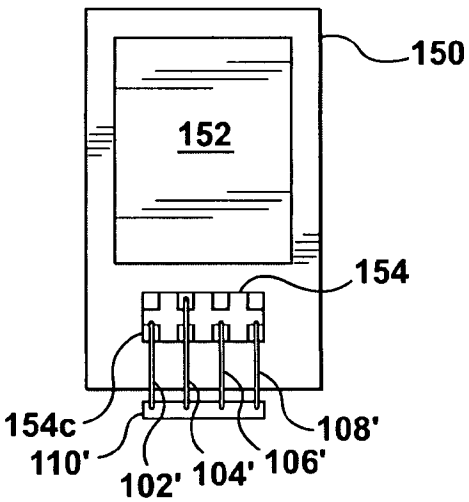
FIG. 5C is an illustration of the connections between an alternative embodiment of the connector of FIG. 4 and the data card of FIG. 5A when the data card is inserted into the interface device of FIG. 5B.
Figure 5D:
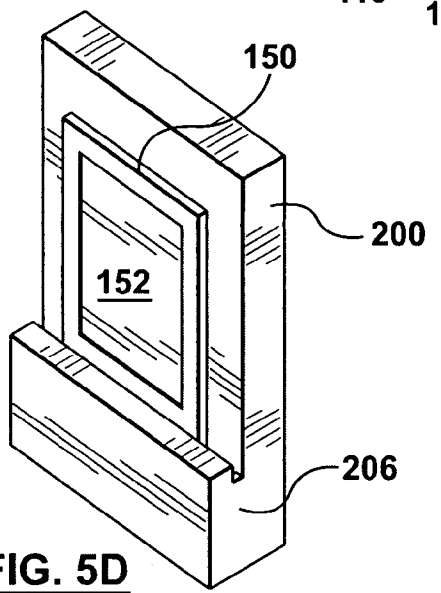
FIG. 5D is an isometric view of the data card of FIG. 5A inserted into the electronic data card interface device of FIG. 5B.
Figure 5B:
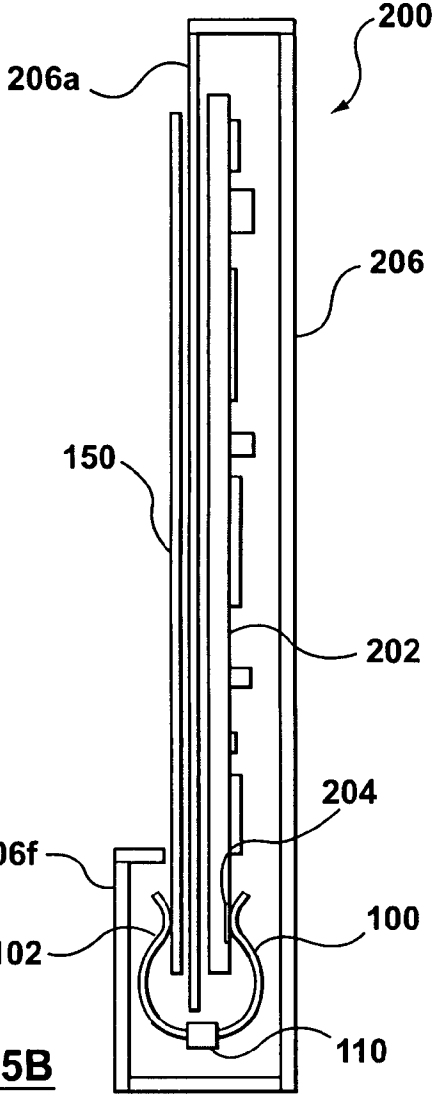
FIG. 5B is a cross-sectional side view of an exemplary electronic data card interface device incorporating the connector of FIG. 4 to electrically and mechanically couple the data card of FIG. 5A with a printed circuit board of the device.
Figure 5A:
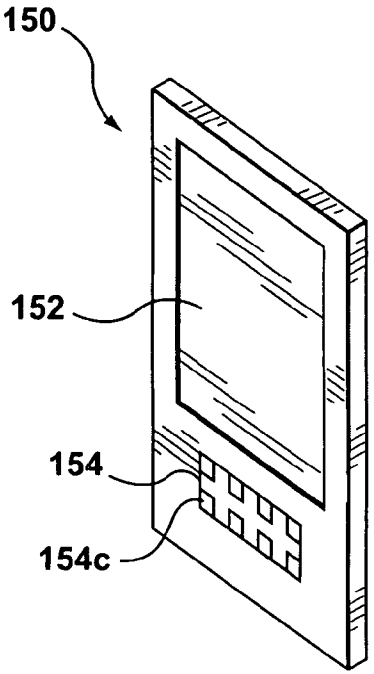
FIG. 5A is an isometric view of an exemplary data card.

Referring now to FIG. 5A, shown therein is an isometric view of an exemplary data card 150. The data card 150 may be, for example, but is not limited to, a subscriber identity module (SIM) card or a common access card (CAC). These types of data cards are commonly referred to as smart cards by persons skilled in the art. In this example, the data card 150 comprises a visual information display portion 152 and an electrical contact area 154 for accessing a computer microchip contained within or on the surface of the data card 150. The visual information display portion 152 may include several visual indicators including, but not limited to, a photograph, a name, an ID number, a rank for military personnel, and an identification bar code which are each associated with the user of the data card 150. The contact portion 152 can include a plurality of discreet electrical contact areas or regions 154*c* (only one of which is labeled for simplicity) to allow multiple discreet connections with a data card reader. The exact number and relative locations of electrical contact areas 154*c* can be determined by manufacturer or chip card standards.

There is digital information contained on the microchip that corresponds to the personal identification information contained within the visual information display portion 152 of the data card 150. Both types of information can be used together for identity verification or security access. Therefore, in use, a security device or security personnel can cross-reference the information contained in the visual information display portion 152 of the data card 150 with the information stored on the microchip, which is accessed via the electrical contact area 154. Typically the visual information contained within the visual information display 152 of the data card 150 is visually reviewed while information stored on the microchip of the data card 150 is accessed by inserting the data card 150 into a data card interface device (see FIGS. 5B and 5D for example) that electrically couples with the electrical contact area 154.

Referring now to FIG. 5B, shown therein is a cross-sectional view of an exemplary electronic data card interface device 200 incorporating the connector 100 to electrically and mechanically couple the data card 150 with a printed circuit board (PCB) 202 of the device 200. The PCB 202 has an electrical contact area 204 with a suitable number of contact pads (not shown) for electrically communicating with the data card 150. The device 200 also includes a housing 206, as well as other components as is commonly known by those skilled in the art. Due to the use of the connector 100, the housing 206 can be thinner and can have a reduced frontal footprint or base 206*f*, which allows for an increase in the amount of the visual information display portion 152 of the data card 150 that can be displayed. A thinner housing translates to a more portable and useable device. In some embodiments, the housing 206 can also be transparent. This is in contrast with conventional data readers that require a larger and thicker housing due to the use of a conventional connector. Accordingly, in conventional device readers, the housing provides all of the structural support and mechanical clamping force. In these conventional readers, the larger and thicker housing obscures the visual information display portion 152 of the data card 150 so that the display portion 152 cannot be visually reviewed while data from the microchip is being obtained.

It should be noted that the connector 100 and the connecting elements 102-108 can be constructed with a variety of heights and shapes in order to meet the requirements of different data card and device reader configurations. For instance, the number, relative height, and relative position of the connecting elements 102-108 is determined by the electrical contact layout within the electrical contact portions 154 and 204 of the data card 150 and the PCB 202 respectively. The connecting elements 102-108 can also be of different thicknesses, even for the same connector at different portions, to correspond with contact pads of varying sizes.

The insulating member 110 serves as a means for keeping the connecting elements 102-110 in their appropriate, relative positions. In other embodiments, the insulating member 110 can be shaped differently as required. The insulating member 110 can also be placed in a different location. In some cases the insulating member 110 can be optional. For instance, in some embodiments, the insulating member 110 can be provided by other elements, such as a portion of the housing 206 of the device 200.

The connector 100 provides both an electrical connection and mechanical clamping pressure between the data card 150, the PCB 202 and a portion 206*a* of the device housing 206. The connecting elements 102-108 are therefore designed to create the appropriate amount of spring force to mechanically secure the data card 150 and to ensure a good electrical connection between the electrical contact pads of the data card 150 and the PCB 202 to allow for the transfer of information between the data card 150 and the PCB 202.

The design of the connector 100 is such that it eliminates the need for the device housing 206 to provide any mechanical clamping pressure on the data card 150 or the PCB 202. Eliminating the need for mechanical clamping pressure, allows for the device housing 206 to be thinner and therefore decreases the overall bulk of the data card interface device 200. Furthermore, while the connecting elements 102-108 are designed to exert a mechanical clamping pressure on the data card 150 and the PCB 202 to hold the data card 150 securely within the data card interface device 202, the connecting elements 102-108 are also designed such that the data card 150 can be slidably removed and inserted as needed.

Referring now to FIG. 5C, shown therein is an illustration of the connections between an exemplary alternative connector 100' and the data card 150 when the data card 150 is inserted into the electronic device 200. As can be seen, electrical connections between the connector 100 and the electrical contact area 154 of the data card 150 is made by varying the height of the end portions of the electrical connectors 102-108 which are held in the correct location by the insulating member 110. Depending on the type of data card, not all of the electrical contact pads of the data card 150 need to be connected with the connector 100. If some of the contact pads are not used, the connector can be made accordingly, i.e. with fewer connecting elements.

Referring now to FIG. 5D, shown therein is an isometric view of the data card 150 inserted into the electronic data card interface device 200. The connector 100 allows for the amount of housing 206 of the device 200 to be reduced, and configured in such a way as to display all or almost all, of the visual information displayed in the visual information display portion 152 of the data card 150. This allows for the simultaneous inspection of the visual information contained in the visual information display portion 152 of the data card 150 and the retrieval of the digital information contained within the microchip of the data card 150.

Figure 6C:
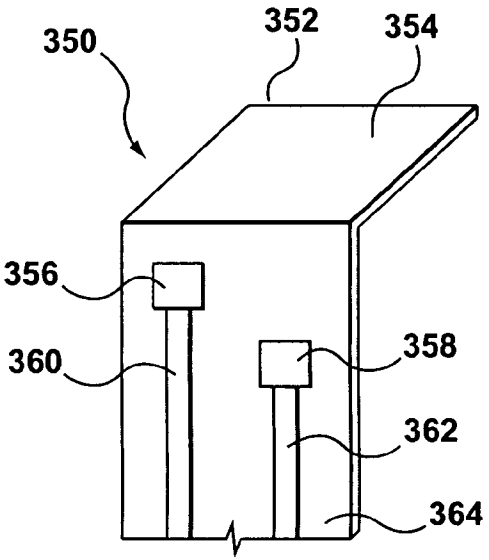
FIG. 6C is an illustration of a portion of an exemplary alternative embodiment of a connector.
Figure 6B:
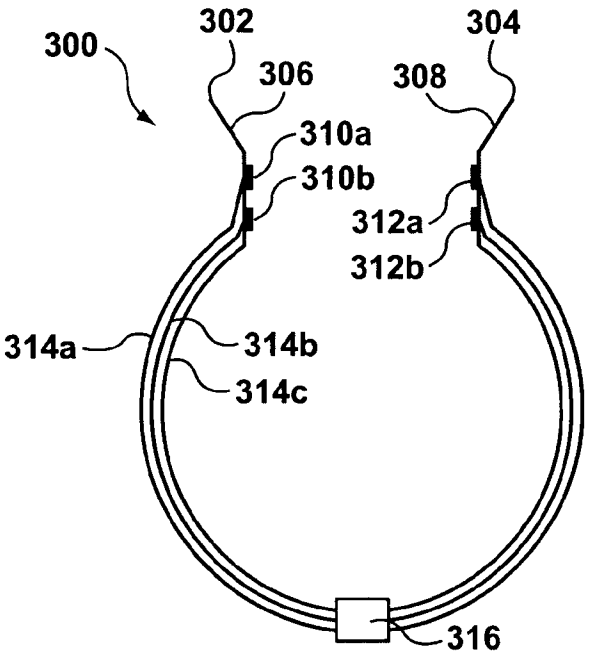
FIG. 6B is an illustration of an exemplary alternative embodiment of a connector.
Figure 6A:
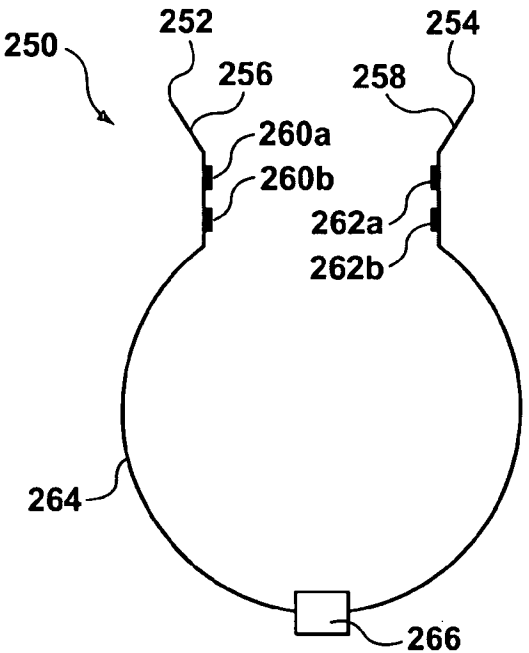
FIG. 6A is an illustration of an exemplary alternative embodiment of a connector.

Referring now to FIG. 6A, shown therein is an illustration of an exemplary alternative embodiment of a connector 250 comprising a single connecting element. The connector 250 includes two free ends 252 and 254, first and second guidance portions 256 and 258, contact portions 260*a*, 260*b*, 262*a* and 262*b*, a biasing portion 264 and an insulating member 266. The connector 250 is generally similar to the connector 10 except that there is now more than one contact portion on a given side of the connector 250. The contact portions 260*a*, 260*b*, 262*a* and 262*b* can also be referred to as contact pads. The contact portions 260*a* and 260*b* can electrically contact the same contact area on a first object, and the contact portions 262*a* and 262*b* can electrically contact the same contact area on a second object, thus providing for redundancy. Alternatively, there can be cases when only one of contact portions 260*a* and 260*b* electrically contact a contact area on a first object, and only one of contact portions 262*a* and 262*b* electrically contact a contact area on a second object. The contact portions 260*a*, 260*b*, 262*a* and 262*b* are electrically connected to one another by the biasing member 264. It should also be understood that a connector can also be made by packaging together several connectors 250 with an insulating member or carrier similar to the connector 100 shown in FIG. 4A. There can also be variations of the connector 250 as shown in FIGS. 3A, 3B, 4B and 4C.

Referring now to FIG. 6B, shown therein is an illustration of another exemplary alternative embodiment of a connector 300. The connector 300 includes two free ends 302 and 304, first and second guidance portions 306 and 308, contact portions 310*a* and 310*b*, contact portions 312*a* and 312*b*, biasing portions or members 314*a*, 314*b* and 314*c* and an insulating member 316. The connector 250 is somewhat similar to the connector 250 except that the contact portions 310*a* and 310*b* are electrically isolated from one another as are contact portions 312*a* and 312*b*. Biasing portion 314*c* is made from an insulating material and is used to provide structural stability and electrical isolation to contact portions 310*a*, 310*b*, 312*a* and 312*b*. Biasing member 314*a* electrically connects contact portions 310*a* and 312*a*, and biasing member 314*b* electrically connects contact portions 310*b* and 312*b*. The insulating member 316, or another suitable structure, provides a spaced relationship between the biasing members 314*a* and 314*b* to prevent inadvertent electrical contact. The biasing members 314*a* and 314*b* may also be coated with an insulating material to prevent inadvertent electrical contact. The connector 300 can be used when first and second objects have contact areas with two contact pads that are vertically or horizontally situated with respect to one another. It should also be understood that a connector can also be made by packaging together several connectors 300 with an insulating member or carrier similar to the connector 100 shown in FIG. 4A. There can also be variations of the connector 300 as shown in FIGS. 3A, 3B, 4B and 4C. Further, rather than using the biasing portion 314*c*, the connector 300 can include two short insulating members; one insulating member is used for physically, but not electrically, coupling contact portions 310*a* and 310*b* together and the other insulating member is used for physically, but not electrically, coupling contact portions 312*a* and 312*b*.

Referring now to FIG. 6C, shown therein is an illustration of a portion of another exemplary alternative embodiment of a connector 350. One end portion of the connector 350 is shown including a free end 352, a guidance portion 354, contact portions 356 and 358, conductors 360 and 362 and a biasing portion 364. In this case, the biasing portion 364 is a ribbon or strip-like structure, made from an insulating material that is semi-rigid to provide the required mechanical properties. The conductors 360 and 362 may be conductive traces. The connector 350 is similar to the connector 300 in that there is no electrical connection between the contact portions 356 and 358. It should be understood the other end of the connector 350 includes a similar structure, with third and fourth contact portions (not shown) that are electrically connected to the contact portions 356 and 358 by the conductors 360 and 362. It should also be understood that a connector can also be made by packaging together several connectors 350 with an insulating member or carrier similar to the connector 100 shown in FIG. 4A. There can also be variations of the connector 350 as shown in FIGS. 3A, 3B, 4B and 4C.

In the connector embodiments shown herein with an insulating member, the insulating member can be aligned with respect to an alignment tab in the device housing to prevent the connector from moving when in use. Also, the insulating member can serve as a stop so that the downward movement of the object relative to one another can be controlled. In this case, it should be understood that the size and location of the insulating member is selected to provide this function.

For the sake of convenience, various connectors have been described with reference to use with a data card and a data card interface device. However, the connectors described herein can be used in any type of device that requires physical and electrical coupling between two objects. Such devices include, but are not limited to, stationary card readers, mobile and hand held devices, portable card readers, a display, a fingerprint scanning module and other stationary or mobile card interface devices. It should also be understood that the connector can be used to electrically and physically connect two data cards, two PCBs, or any other similar objects with compatible electrical contact portions.

The connector can provide a mechanical clamping pressure in addition to a functional electrical connection between two objects thus omitting the need for a larger housing to physically force an electrical connector to make an electrical contact between the two objects. Accordingly, the various connector embodiments shown herein reduce the structural demands on the housing, allowing for reduced housing coverage, size and thickness, and ultimately allowing for smaller, mobile friendly devices. In addition, the contact portions of the connector need only be as large as the footprint of the contact pads so that important information can still be displayed.

Furthermore, in the figures, the various connectors are shown as being positioned below two objects. However, it should be understood to persons skilled in the art that the connectors described herein can be positioned differently. For instance, the connector can be positioned from the side of the objects rather than the bottom. However, this can also depend on the layout of the contact areas and/or pads on the objects. Accordingly, the connectors described herein can be positioned in different orientations. This can allow for various ways of inserting objects, such as data cards into a data card interface device.

In one aspect, at least one embodiment described herein provides a connector for providing electrical and mechanical coupling between first and second objects. The connector comprises at least one connecting element comprising: at least one first contact portion; at least one second contact portion; at least one guidance portion located towards the end of the at least one connecting element and adjacent to one of the at least one first and second contact portions; and a biasing portion adjacent to the at least one first and second contact portions, and configured to provide an electrical connection therebetween and to resiliently move the at least one connecting element from a first position to a second position having a wider distance between the at least one first and second contact portions. When the connector is applied to the first and second objects, the at least one connecting element moves from the first position to the second position in which the biasing portion provides a mechanical coupling force to the first and second objects and the at least one first contact portion electrically contacts a first contact area on the first object and the at least one second contact portion electrically contacts a second contact area on the second object to electrically couple the first and second objects.

The first object can be one of a data card and a printed circuit board, and the second object can be one of a data card and a printed circuit board.

The at least one connecting element generally can have a horseshoe shape.

In at least some cases, the at least one connecting element can be made from a piece of conductive wire.

In at least some cases, the biasing portion can be arranged to provide a clearance area between the bottom of the first and second objects with respect to an upper surface of the biasing portion. Alternatively, in other cases, an upper surface of the biasing portion can be arranged to abut with the bottom of at least one of the first and second objects.

In some cases, the at least one connecting element comprises a third contact portion adjacent and electrically coupled to the first contact portion, and a fourth contact portion adjacent and electrically coupled to the second contact portion.

In some cases, the at least one connecting element comprises a third contact portion adjacent and physically coupled to the first contact portion, a fourth contact portion adjacent and physically coupled to the second contact portion, and a conductive biasing member configured to electrically couple the third and fourth contact portions during use.

In some cases, the at least one connecting element comprises a third contact portion adjacent and physically coupled to the first contact portion, a fourth contact portion adjacent and physically coupled to the second contact portion, and conductors configured to electrically couple the third and fourth contact portions during use, and wherein the biasing portion is made from a strip-like material.

In some cases, the at least one connecting element comprises two guidance portions located between the first and second ends and the first and second contact portions.

In some cases, the at least one connecting element comprises a straight end portion.

In some cases, one end portion of the at least one connecting element is connected to one of the first and second objects with a solder connection.

In some cases, the at least one connecting element further comprises an insulating member along a section of the at least one biasing portion.

In some cases, the connector further comprises a plurality of electrical connecting elements and an insulating member configured to maintain a spaced relationship between the plurality of electrical connecting elements.

In some cases, the at least one electrical connecting element comprises end portions with different heights.

In some cases, the at least one connecting element comprises a curved end portion and a straight end portion.

In another aspect, at least one embodiment described herein provides an electronic device comprising: a housing; internal electronics configured to provide at least one function for the electronic device; a first object including at least a portion of the internal electronics and a first contact area; a second object including a second contact area; and a connector configured to provide electrical and mechanical coupling between the first and second objects. The connector comprises at least one connecting element comprising at least one first contact portion; at least one second contact portion; at least one guidance portion located towards the end of the connecting element and adjacent to one of the at least one first and second contact portions; and a biasing portion adjacent to the at least one first and second contact portions, and configured to provide an electrical connection therebetween and to resiliently move the at least one connecting element from a first position to a second position having a wider distance between the at least one first and second contact portions. In use, the at least one guidance portion receives one of the first and second objects which forces the at least one connecting element from the first position to the second position in which the biasing portion provides a mechanical coupling force to the first and second objects and the at least one first contact portion electrically contacts the first contact area on the first object and the at least one second contact portion electrically contacts the second contact area on the second object to electrically couple the first and second objects.

The connector can have structural properties as described above.

The connector can further comprise a plurality of electrical connecting elements and an insulating member configured to maintain a spaced relationship between the plurality of electrical connecting elements.

The electronic device can be a smart card reader, and the first object can be a data card. Alternatively, the first object can be one of a data card and a printed circuit board, and the second object can be one of a data card and a printed circuit board.

In another aspect, a method of electrically and mechanically coupling first and second objects is described herein in which the method comprises applying a connector as described herein to the first and second objects such that the at least one connecting element moves from the first position to the second position in which the biasing portion provides a mechanical coupling force to the first and second objects and the at least one first contact portion electrically contacts a first contact area on the first object and the at least one second contact portion electrically contacts a second contact area on the second object to electrically couple the first and second objects.

It should be understood that various modifications can be made to the embodiments described and illustrated herein, without departing from the embodiments, the general scope of which is defined in the appended claims.

The invention claimed is:

1. A connector for providing electrical and mechanical coupling between first and second objects, the connector comprising:

a plurality of connecting elements, a given connecting element comprising:

at least one first contact portion;

at least one second contact portion;

a guidance portion located towards an end of the given connecting element and adjacent to the at least one first contact portion;

a straight end portion comprising the at least one second contact portion, and connected to one of the first and second objects by a solder connection; and a biasing portion projecting from opposite surfaces of an insulating member, the biasing portion is adjacent to the at least one first contact portion and the straight end portion, rounded in an area adjacent to the at least one first contact portion, and configured to provide an electrical connection between the at least one first and at least one second contact portions, and to resiliently move the given connecting element from a first position to a second position, wherein the at least one first and at least one second contact portions are separated by a first distance in the first position and a second distance in the second position, the second distance being greater than the first distance;

wherein, when applied to the first and second objects, each of the plurality of connecting elements moves from the first position to the second position in which the biasing portion provides a mechanical coupling force to the first and second objects and the at least one first contact portion electrically contacts a first contact area on the first object and the at least one second contact portion electrically contacts a second contact area on the second object to electrically couple the first and second objects.

2. The connector as claimed in claim 1, wherein the first object comprises a data card or a printed circuit board, and the second object comprises a data card or a printed circuit board.

3. The connector as claimed in claim 1, wherein each of the plurality of connecting elements comprises a piece of conductive wire.

4. The connector as claimed in claim 1, wherein the biasing portion of each of the plurality of connecting elements provides a clearance area between a bottom of the first and second objects with respect to an upper surface of the biasing portion.

5. The connector as claimed in claim 1, wherein an upper surface of the biasing portion is arranged to abut with a bottom of at least one of the first and second objects.

6. The connector as claimed in claim 1, wherein the insulating member is configured to maintain a spaced relationship between the plurality of connecting elements.

7. The connector as claimed in claim 1, wherein at least one of the plurality of connecting elements comprises end portions with different heights.

8. The connector as claimed in claim 1, wherein the at least one connecting element comprises a curved end portion, the curved end portion comprising at least the guidance portion.

9. The connector as claimed in claim 1, wherein when applied to the first and second objects, at least one of the plurality of connecting elements is connected to one side of the second object by a respective solder connection, and at least one other of the plurality of connecting elements is connected to one other side of the second object.

10. An electronic device comprising:

a housing;

internal electronics configured to provide at least one function for the electronic device;

a first object comprising at least a portion of the internal electronics and a first contact area;

a second object comprising a second contact area; and a connector configured to provide electrical and mechanical coupling between the first and second objects, the connector comprising:

a plurality of connecting elements, a given connecting element comprising:

at least one first contact portion;

at least one second contact portion;

a guidance portion located towards an end of the given connecting element and adjacent to the at least one first contact portion;

a straight end portion comprising the at least one second contact portion, and connected to one of the first and second objects by a solder connection; and a biasing portion projecting from opposite surfaces of an insulating member, the biasing portion is adjacent to the at least one first contact portion and the straight end portion, rounded in an area adjacent to the at least one first contact portion, and configured to provide an electrical connection between the at least one first and at least one second contact portions, and to resiliently move the given connecting element from a first position to a second position, wherein the at least one first and at least one second contact portions are separated by a first distance in the first position and a second distance in the second position, the second distance being greater than the first distance;

wherein, in use, the guidance portion receives one of the first and second objects which forces each of the plurality of connecting elements from the first position to the second position in which the biasing portion provides a mechanical coupling force to the first and second objects and the at least one first contact portion electrically contacts the first contact area on the first object and the at least one second contact portion electrically contacts the second contact area on the second object to electrically couple the first and second objects.

11. The electronic device of claim 10, wherein the electronic device comprises a smart card reader, and the first object comprises a data card.

12. The electronic device of claim 10, wherein the first object comprises a data card or a printed circuit board, and the second object comprises a data card or a printed circuit board.

13. The electronic device of claim 10, wherein each of the plurality of connecting elements comprises a piece of conductive wire.

14. The electronic device of claim 10, wherein the biasing portion of each of the plurality of connecting elements provides a clearance area between a bottom of the first and second objects with respect to an upper surface of the biasing portion.

15. The electronic device of claim 10, wherein an upper surface of the biasing portion is arranged to abut with a bottom of at least one of the first and second objects.

16. The electronic device of claim 10, wherein the insulating member is configured to maintain a spaced relationship between the plurality of connecting elements.

17. The electronic device of claim 10, wherein at least one of the plurality of connecting elements comprises end portions with different heights.

18. The electronic device of claim 10, wherein the at least one connecting element comprises a curved end portion, the curved end portion comprising at least the guidance portion.

19. The electronic device of claim 10, wherein when applied to the first and second objects, at least one of the plurality of connecting elements is connected to one side of the second object by a respective solder connection, and at least one other of the plurality of connecting elements is connected to one other side of the second object.

20. A method of electrically and mechanically coupling first and second objects, the method comprising:

applying a connector to said first and second objects;

wherein said connector comprises a plurality of connecting elements;

wherein a given connecting element comprises at least one first contact portion, at least one second contact portion, a guidance portion located towards an end of the given connecting element and adjacent to the at least one first contact portion, a straight end portion comprising the at least one second contact portion and connected to one of the first and second objects by a solder connection, and a biasing portion projecting from opposite surfaces of an insulating member, the biasing portion is adjacent to the at least one first contact portion and the straight end portion, rounded in an area adjacent to the at least one first contact portion, and configured to provide an electrical connection between the at least one first and at least one second contact portions, and to resiliently move the given connecting element from a first position to a second position, wherein the at least one first and at least one second contact portions are separated by a first distance in the first position and a second distance in the second position, the second distance being greater than the first distance;

wherein, when said connector is applied to the first and second objects, each of the plurality of connecting elements moves from the first position to the second position in which the biasing portion provides a mechanical coupling force to the first and second objects and the at least one first contact portion electrically contacts a first contact area on the first object and the at least one second contact portion electrically contacts a second contact area on the second object to electrically couple the first and second objects.

* * * * *